US009708159B2

(12) United States Patent
Rieser et al.

(10) Patent No.: US 9,708,159 B2
(45) Date of Patent: Jul. 18, 2017

(54) SAFETY BRAKE FOR A TRAVEL BODY OF AN ELEVATOR SYSTEM

(71) Applicant: Inventio AG, Hergiswil (CH)

(72) Inventors: Benedikt Rieser, Kerns (CH); Daniel Meierhans, Luzern (CH); Faruk Osmanbasic, Cham (CH); Michael Geisshüsler, Luzern (CH)

(73) Assignee: Inventio AG, Hergiswil (CH)

( * ) Notice: Subject to any disclaimer, the term of this patent is extended or adjusted under 35 U.S.C. 154(b) by 90 days.

(21) Appl. No.: 14/647,535

(22) PCT Filed: Nov. 15, 2013

(86) PCT No.: PCT/EP2013/073990
§ 371 (c)(1),
(2) Date: May 27, 2015

(87) PCT Pub. No.: WO2014/082877
PCT Pub. Date: Jun. 5, 2014

(65) Prior Publication Data

US 2015/0298937 A1 Oct. 22, 2015

(30) Foreign Application Priority Data

Nov. 27, 2012 (EP) ..... 12194422

(51) Int. Cl.
*B66B 5/20* (2006.01)
*B66B 5/18* (2006.01)

(52) U.S. Cl.
CPC . *B66B 5/20* (2013.01); *B66B 5/18* (2013.01)

(58) Field of Classification Search
CPC ..... B66B 5/18; B66B 5/20
See application file for complete search history.

(56) References Cited

U.S. PATENT DOCUMENTS 6,092,630 A * 7/2000 Wendel ..... B66B 5/18 187/373
6,176,350 B1 * 1/2001 Schlosser ..... B66B 5/20 187/359

(Continued)

FOREIGN PATENT DOCUMENTS

DE 29619729 U1 3/1998
EP 1048602 A1 11/2000

(Continued)

*Primary Examiner* — Minh Truong
(74) *Attorney, Agent, or Firm* — Shumaker Loop & Kendrick; William J. Clemens

(57) ABSTRACT

A safety brake for an elevator system having at least one traveling body movable in an elevator shaft along a guide rail and/or a brake rail. The safety brake is suitable for braking and retaining the traveling body on the guide and/or brake rail as required. The safety brake includes a control plate for receiving a brake body and for positioning the brake body relative to the guide and/or brake rail. The brake body is designed in at least two pieces and includes a first brake element and a second brake element. The first brake element is solely for braking and retaining purposes when the traveling body is moving along the guide and/or brake rail in an upward direction, and the second brake element is solely for braking and retaining purposes when the traveling body is moving along the guide and/or the brake rail in a downward direction.

18 Claims, 5 Drawing Sheets

(56) References Cited

U.S. PATENT DOCUMENTS

| | | | | |
|---|---|---|---|---|
| 6,659,230 | B1 * | 12/2003 | Jenkins | B66B 5/20 187/202 |
| 6,758,310 | B2 * | 7/2004 | Muff | B66B 5/22 187/368 |
| 7,299,898 | B2 * | 11/2007 | Husmann | B66B 5/20 187/365 |
| 9,120,643 | B2 * | 9/2015 | Meierhans | B66B 5/20 |
| 2010/0300813 | A1 * | 12/2010 | Kigawa | B66B 5/00 187/247 |
| 2011/0226560 | A1 * | 9/2011 | Husmann | B66B 5/18 187/359 |
| 2012/0152663 | A1 * | 6/2012 | Legeret | B66B 5/20 187/404 |
| 2015/0329323 | A1 * | 11/2015 | Osmanbasic | B66B 5/20 187/359 |

FOREIGN PATENT DOCUMENTS

| | | | |
|---|---|---|---|
| EP | 2112116 | A1 | 10/2009 |
| WO | 2012080104 | A1 | 6/2012 |
| WO | 2012128758 | A1 | 9/2012 |

* cited by examiner

SAFETY BRAKE FOR A TRAVEL BODY OF AN ELEVATOR SYSTEM

FIELD

The invention relates to a safety brake and to a method for braking and fixing a travel body of an elevator installation by means of the safety brake, when required, as well as to an elevator installation with a safety brake of that kind.

BACKGROUND

Elevator installations are installed in buildings and usually consist of, inter alia, an elevator car which is held by a support device. The elevator car is movable by means of a drive in an upward direction, i.e. substantially opposite to the action of gravitational force, or in a downward direction, i.e. substantially in the direction of action of the gravitational force, for transport of persons and/or goods. The movement of the elevator car, also termed travel body, takes place substantially in the vertical direction.

Known elevator installations of that kind frequently comprise safety brakes in order, in the case of failure of the drive or the support device, to secure this or also to safeguard against unintended drifting away or dropping down.

A safety brake comprising an eccentrically constructed brake body is known from EP 2 112 116 A1. The brake body is arranged in a housing. In operation, the housing together with the brake body is so displaced that the brake body bears against a brake rail and is pivoted by the relative movement between brake body and brake rail. Brake regions of the brake body are thereby positioned at the brake rail so that braking of the travel body takes place. In order to achieve the braking action a counter-braking plate for setting the braking force is arranged in the housing.

In addition, WO 2012/080104 A1 discloses a safety brake with a pivotable entraining body for actuation of the safety brake on contact with a brake rail by relative movement between entraining body and brake rail.

There is a need to design more reliably and to constructionally simplify the positioning of the brake body relative to the brake rail and/or a guide rail of the travel body. In addition, there is a need to similarly constructionally simplify and to design more reliably the restoration of the safety brake from a braking position to a rest position in which the safety brake does not exert a braking action.

SUMMARY

It is therefore an object of the present invention to avoid the disadvantages of the prior art. In particular, a device and a method of the kind stated in the introduction shall be provided by which braking and fixing of the travel body of an elevator installation can take place reliably. In addition, the safety brake shall be constructionally simple. Moreover, it is, in particular, an object to ensure a reliable and economic design of the equipment for resetting the safety brake into the rest position in which no braking action is exerted.

The safety brake for an elevator installation with at least one travel body, which is arranged to be movable along a guide rail and/or a brake rail in an elevator shaft, is suitable for braking and fixing the travel body at the guide rail and/or at a brake rail when required. The safety brake comprises a support for mounting a brake body and a control plate or base plate for positioning the brake body relative to the guide rail and/or the brake rail. The brake body is of at least two-part construction and comprises a first brake element and a second brake element. The two brake elements are movable substantially independently of one another. The first brake element is designed substantially only for braking and fixing in the case of movement of the travel body along the guide rail and/or the brake rail in an upward direction. The second brake element is designed substantially only for braking and fixing in the case of movement of the travel body along the guide rail and/or the brake rail in a downward direction. The control plate can also be termed base plate since it is constructed for holding the brake elements in a basic position. These terms are, in this connection, equivalent.

The two brake elements can, when required, together be brought into contact with the guide rail and/or the brake rail or adjusted relative thereto. Depending on the travel direction of the brake body, due to a friction couple between brake body and guide rail and/or brake rail the corresponding brake element is necessarily entrained and brought into an end or second braking position.

This has the advantage that the brake body is adaptable in simple manner to the respective requirements for braking force for the upward direction and/or downward direction, which makes operation of the brake more reliable and also more economic. It is possible, for example, in the case of corresponding wear of a brake element to exchange only this if the wear of the brake elements of the brake body is different for the different directions. Thus, operation of the safety brake in a given case is more economic by comparison with previously known safety brakes. In addition, the need for space of the safety brake can be optimized, since the brake element needed can be moved independently of the other brake element.

In particular, the device comprises a counter-braking body which is so arranged that the guide rail and/or the brake rail can be clamped between the brake body and the counter-braking body for generating a braking action. The braking force can in that case be set, inter alia, by the force applied by the counter-braking body to the guide rail and/or brake rail. For example, the counter-braking body can be formed with plate springs by which the effective braking force is settable. Through adjustment of the brake elements relative to the guide rail or brake rail the support is preferably so displaced together with the counter-braking body that the guide rail or brake rail is clamped between the brake body and the counter-braking body.

The control plate is preferably positionable in a rest position and a braking position. The positioning can be effected by means of a linear movement and/or pivot movement of the control plate. For example, the control plate can thus be positioned from the rest position into the braking position by means of a linear movement, a pivot movement or a combination of linear movement and pivot movement. In addition, the positioning of the control plate from the braking position back into the rest position can analogously take place by means of linear movement, pivot movement or a combination of linear movement and pivot movement.

This has the advantage that, for the purpose of actuation of the safety brake, only the control plate is positioned in the support, whereby it moves the brake body into a first braking position or adjusts it relative to the rail. Thus, actuation of the safety brake can take place in dependently of travel direction and for the purpose of actuation, for example, the entire housing of the safety brake does not have to be displaced. This makes construction of the safety brake, particularly the actuating equipment thereof, simpler and more economic by comparison with the prior art. In addition, a linear movement or also a pivot movement of merely the control plate from the rest position to the braking position and conversely can be realized in constructionally simple and reliable manner.

The control plate can preferably be held in the rest position by means of an electromagnet which is, in particular, able to be switched off. This has the advantage that a construction of that kind can be realized in simple manner and is thus economic. Moreover, it can be ensured that, for example, in the event of power failure the electromagnet is switched off, whereby a braking action of the safety brake is triggered, which enables operation of the safety brake as an emergency brake. Obviously, emergency power supplies, for example a battery or a capacitor, can be provided so as to bridge over temporary power interruptions. Emergency power supplies of that kind are then obviously incorporated in a safety or control concept of the elevator installation.

As an alternative to use of an electromagnet, which can, in particular, be switched off, for holding the control plate in the rest position the use of a mechanical locking device such as a gripper or a pin is also conceivable. This can be releasably connected with the control plate so that the control plate is movable from the rest position to the braking position.

The control plate is preferably movable into the braking position by means of a compression spring. This has the advantage that the control plate is reliably movable, for example, in the case of power failure, from the rest position to the braking position by exertion of a force on the control plate by the at least one compression spring in the direction of the braking position.

As an alternative to use of a compression spring for positioning the control plate from the rest position to the braking position the positioning can also be effected by means of a hydraulic, pneumatic or electrical drive, such as known to the expert. In addition, the use of, for example, a tension spring is also conceivable.

The first brake element and/or the second brake element is or are preferably pivotable. In particular, the first brake element and/or the second brake element is or are pivotable, particularly in opposite directions, about a common axle preferably arranged in or at the support. This has the advantage that through the positioning of the control plate and a corresponding pivotation of the brake elements these can be brought into contact with the guide rail and/or brake rail. This can be realized in constructionally simple manner, reliably and economically, since there is no need for complicated equipment for positioning the safety brake. In addition, advantageously the initial forces necessary for actuation of the brake elements are low, since in each instance only the individual brake elements are pivoted.

The first brake element and/or the second brake element is or are preferably so pivotable from a basic position into a first braking position that the first brake element and/or the second brake element is or are in contact with the guide rail and/or the brake rail.

In the sense of the present invention substantially no braking or fixing takes place if the first brake element and/or the second brake element is or are in the first braking position in contact with the guide rail and/or the brake rail.

For preference, the first brake element and/or the second brake element is or are pivotable from the first braking position to a second braking position by friction couple with the guide rail.

This has the advantage that by means of a simple pivot movement of at least one brake element, which is in contact with the guide rail and/or brake rail, this can be brought from the first braking position to a second braking position, which can be realized in constructionally simple manner. By virtue of the relative movement between guide rail and/or brake rail and the corresponding brake element a further pivotation of the brake element can now take place, whereby the braking action of the safety brake is enhanced. In that regard, it is particularly advantageous that this further pivotation is directly dependent on the direction of the relative movement. This direction is thus decisive with regard to which of the two brake element is pivoted into the final, second braking position. A braking force for downward travel and upward travel can thus be individually predetermined by means of the form of the brake elements.

In particular, release of the safety brake by return pivotation of the first brake element and/or the second brake element through friction couple with the guide rail and/or the brake rail from the second braking position to the first braking position can take place. This corresponds with, in particular, an opposite relative movement with respect to the relative movement for pivotation of the corresponding brake element from the first braking position to the second braking position. This has the advantage that release of the safety brake by pivotation of the corresponding brake element from the second braking position to the first braking position can be effected in constructionally simple and reliable manner, since, for example, additional resetting equipment is not necessary. The corresponding brake element can be brought from the first brake position into the basic position by appropriate return pivotation.

The control plate is preferably movable from the braking position to the rest position by pivotation of the first brake element and/or the second brake element from the first braking position to the second braking position. In other words, through pivotation of one of the brake elements from the first braking position to the second braking position the control plate is moved back from the braking position to the rest position.

This has the advantage that on the one hand the first and/or second brake element is or are moved into the first braking position by positioning of the control plate from its rest position to the braking position. On the other hand, through the subsequent further movement, which is produced by friction couple with the guide rail and/or the brake rail, of the first brake element or the second brake element the control plate is moved back from its braking position to the rest position. In the basic position the control plate can be held again by means of the locking device. The locking device can be constructed as, for example, an electromagnet which can be switched off. The electromagnet thus holds the control plate in the rest position. When required, the electromagnet is switched off and the control plate is displaced into the braking position, in which case it moves the brake elements into the first braking position. Depending on the travel direction of the travel body the corresponding brake element is moved into the second braking position, whereby the guide rail or brake rail is clamped and the travel body braked. At the same time, on displacement of the corresponding brake element from the first to the second braking position, the control plate can, as described, be moved back relative to the electromagnet. This is particularly advantageous, since now for holding the control plate in the rest position merely the electromagnet can be switched on. No further restoring energy is needed, which further simplifies the constructional design of the safety brake and makes this less expensive.

The first brake element and/or the second brake element is or are preferably constructed as an eccentric disc. This advantageously makes possible a compact and simple mode of construction of the safety brake.

By eccentric disc there is understood in the sense of the present invention a disc with any desired external profile, which is mounted to be pivotable about an axis outside the geometric center point. For example, an appropriately mounted cam disc can be an eccentric disc in the sense of the present invention.

The eccentric disc is preferably curved in a section on the side facing the guide rail and/or the brake rail. In particular, the section in contact with the guide rail and/or the brake rail in the first braking position is curved. With particular preference the radius of the eccentric disc increases referred to the direction of the pivotation from the first to the second braking position. This has the advantage that through the friction couple between eccentric disc in curved region and the guide rail and/or brake rail the eccentric disc is reliably pivotable into the second braking position for achieving the desired braking action.

The eccentric disc is preferably planar in a section on the side facing the guide rail and/or the brake rail. In particular, that section is planar which in the second braking position is in contact with the guide rail and/or the brake rail. This has the advantage that a largest possible contact area between eccentric disc and guide rail and/or brake rail is made possible for achieving a high level of braking action by the safety brake.

In particular, the eccentric disc has a first curved section and a second planar section. The safety brake can be clamped over the region of the first curved section and on reaching the second, planar section the largest possible contact area for braking is available. At the same time, through the planar area a further rotation of the eccentric disc can be stopped. As an alternative, obviously also a continuously curved eccentric disc can be used. In that regard, the braking position can be defined by an abutment which prevents further rotation of the eccentric disc. This alternative can be of advantage in the case of small loads or low speeds, since brake loading is low in correspondence with the small load or a small brake travel.

The eccentric disc is preferably so formed on the side remote from the guide rail and/or brake rail that through pivotation, in particular from the first braking position to the second braking position, of the eccentric disc a restoring force can be exerted on the control plate for movement of the control plate into the rest position.

The control plate preferably has a contact surface of such a kind that on movement of the control plate into the braking position the eccentric disc is pivotable into the first braking position and the restoring force can be exerted on the control plate for pivotation of the eccentric disc into the second braking position.

This design of eccentric disc and control plate has the advantage that restoration of the control plate to the rest position on pivotation of the eccentric disc into the second braking position is achievable by mechanical interactions between eccentric disc and control plate.

For example, the outer surface of the eccentric disc can, in the second braking position, have a greater spacing starting from the pivot axis on the side facing the guide rail and/or brake rail than on the side remote from the guide rail and/or brake rail. The remote side of the eccentric disc in that case presses on the control plate. As a result, a compact mode of construction of the safety brake can advantageously be achieved. The movement of the control plate into the rest position can be achieved through appropriate design of the profile of the control plate which interacts with the eccentric disc. As contact area, the control plate can have on the side facing the eccentric disc, for example, a wedge-shaped surface with which the side of the eccentric disc remote from the guide rail and/or brake rail can co-operate. As a result, on pivotation of the eccentric disc into the second braking position the control plate is correspondingly moved into the rest position.

In particular, the wedge-shaped surface of the control plate is so designed for each brake element that a desired pivotation into the first braking position of the first and second braking elements can take place. For example, the wedge-shaped surface for the first brake element can be arranged in a first direction and for the second brake element in a second direction substantially opposite to the first direction.

The safety brake preferably has a first braking area of the first brake element smaller than a second braking area of the second brake element. In particular, the braking area of the first brake element is at most 75% and more particularly at most 60% of the second braking area. In particular, the first brake element has a first braking area corresponding with approximately 50% of the second braking area of the second brake element.

This has the advantage of an economic design of the safety brake, since in the case of braking of the travel body in an upward direction lower braking forces than in the case of braking in downward direction are needed. That can be realized by appropriate adaptation of the braking areas of the first brake element and the second brake element.

In particular, the braking area of the brake elements is formed by the planar section of the eccentric discs.

For preference the braking area is determined by the thickness of the brake elements and, in particular, the eccentric discs. For example, the thickness of the first brake element can be 50% of the thickness of the second brake element, whereby the first braking area is 50% of the second braking area.

The second brake element preferably comprises two brake parts with, in particular, substantially the same braking area, wherein the first brake element has a first braking area substantially equal to one of the brake parts of the second brake element. This has the advantage that, for example, identical brake parts are usable for braking in upward direction and downward direction and that in each instance only the number of brake parts has to be selected for the corresponding direction. This simplifies handling and, in addition, stock-keeping is simplified, since the same brake parts are usable, which is more economic. For example, the brake parts can be constructed as eccentric discs or other brake discs.

In particular, the first brake element is arranged between the two brake parts of the second brake element. This has the advantage that the stability and braking action of the safety brake is improved, which makes the safety brake more reliable in operation.

For preference, at least one sensor for position monitoring and/or state monitoring at least of the first brake element, the second brake element or the control plate or any combinations thereof is arranged at and/or in the safety brake. This has the advantage that, for example, wear or occurrence of faulty functions can be recognized in good time, which makes operation even more reliable.

The "state monitoring" serves, inter alia, for monitoring the wear of the brake elements, the braking forces which arise and also the speed of pivotation of the brake elements or any combinations thereof.

The first brake element and/or the second brake element are preferably biased in the direction of the control plate. In particular, the biasing is effected by means of at least one spring. This has the advantage that in the rest position of the control plate it is ensured that the brake elements are not unintentionally pivoted in the direction of the guide rail and/or brake rail and the safety brake unintentionally triggered. The spring can be executed as a tension spring, which biases the first brake element and the second brake element in the direction of the basic position. Instead of tension springs, helical springs or a magnetic retraction system is or are possible.

A further aspect relates to an elevator installation comprising a safety brake as described in the foregoing.

An additional aspect relates to a method for braking and fixing a travel body of an elevator installation by means of a safety brake when required. In particular, use is preferably made of a safety brake as described above. The safety brake comprises a control plate for positioning the brake body relative to the guide rail and/or the brake rail. The brake body comprises a first brake element and a second brake element. The first brake element is designed substantially only for braking in the case of movement of the travel body along the guide rail in an upward direction. The second brake element is designed substantially only for braking in the case of movement of the travel body along the guide rail in a second, downward direction opposite to the upward direction. The method comprises the step of braking and/or fixing the travel body by positioning of the first and/or second brake element at the guide rail and/or brake rail. In that case, the first brake element and the second brake element are preferably adjusted by means of the control plate with respect to the guide rail or brake rail and brought into a first braking position. On movement of the travel body along the guide rail in the upward direction the first brake element is brought, independently of the second brake element, from the first braking position to a second braking position. Conversely, on movement of the travel body along the guide rail in a downward direction the second brake element is brought, independently of the first brake element, from the first braking position to the second braking position.

In one application, a safety brake of that kind is used for equipping and/or re-equipping an elevator installation. This includes the step of installing a safety brake as described above at and/or in the elevator installation for producing an elevator installation as described above.

DESCRIPTION OF THE DRAWINGS

Further features and advantages of the invention are explained in more detail in the following by way of embodiments for better understanding and without restricting the invention to the embodiments, wherein.

DETAILED DESCRIPTION

Figure 1:
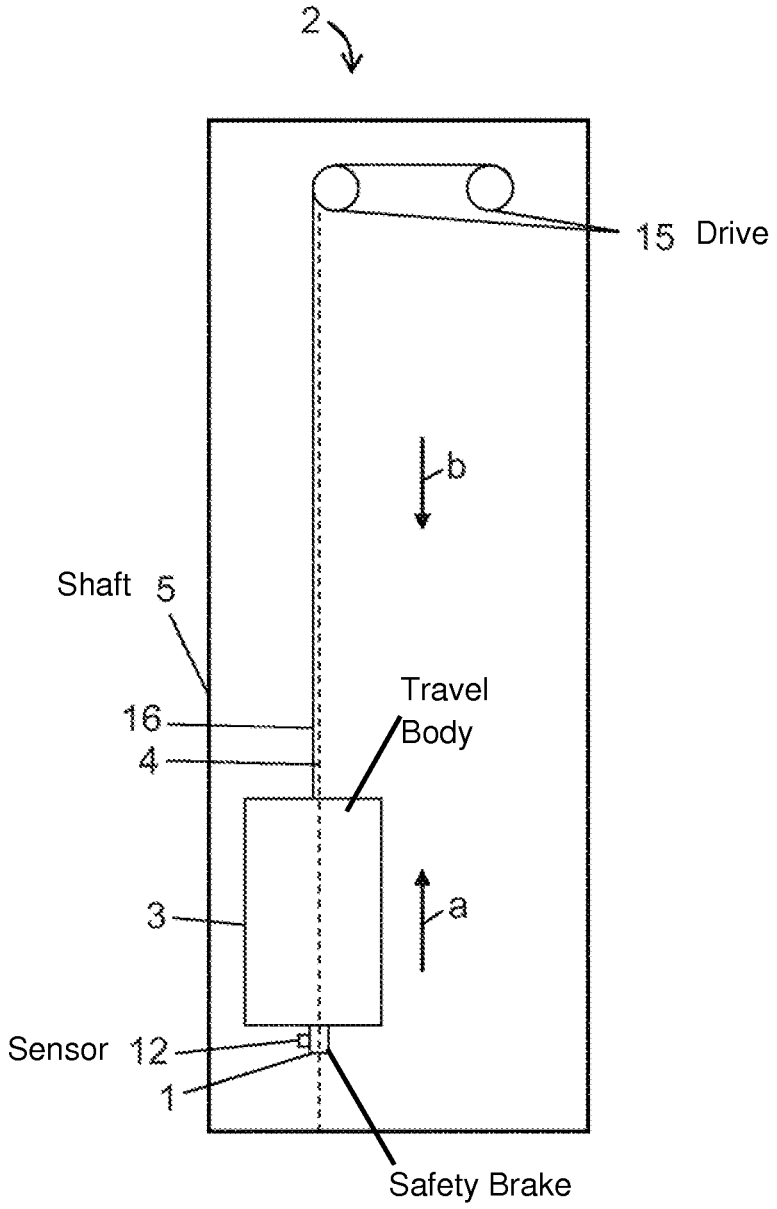
FIG. 1 shows a schematic illustration of an elevator installation with a safety brake according to the invention.

An elevator installation 2 with a travel body 3 comprising a safety brake 1 according to the invention for braking and fixing the travel body 3 when required is shown in FIG. 1 in schematic illustration.

The elevator installation 2 comprises an elevator shaft 5 in which a guide rail 4 is arranged, along which the travel body 3 is movable in an upward direction a or a downward direction b. The travel body 3 is suspended in the elevator shaft 5 by means of support equipment 16 formed by cables. Movement of the travel body 3 in the upward direction a and/or the downward direction b is possible by means of a drive 15, which is in operative connection with the travel body 3 by way of the support equipment 16. In the case of the illustrated elevator installation 2 the travel body 3, frequently an elevator car, is supported to the full extent by the drive 15. As a rule, a further travel body, in the form of a counterweight, is disposed in the elevator shaft, which moves oppositely to the travel body 3 and which is correspondingly fastened to the opposite end of the support equipment 16.

The safety brake 1 mounted on the travel body 3 is constructed so that when required, such as, for example, a failure of the support equipment 16 or in the case of power failure, the travel body can be braked and fixed. For this purpose a braking action is achieved by the safety brake 1 in interaction with the guide rail 4. The guide rail 4 can, in a given case, also be constructed as a brake rail.

Alternatively, the arrangement of a brake rail additionally to the guide rail is also conceivable in order to, for example, brake the travel body 3 only in specific sections in the elevator shaft 5 by means of the safety brake 1.

A sensor 12 for position monitoring and/or state monitoring of the safety brake 1 is arranged at the safety brake 1. The braking action of the safety brake 1 can, for example, be compared by the sensor 12 with a target value, whereby a state monitoring of the safety brake can be achieved. The sensor 12 can obviously also be arranged at a different location on the travel body. The sensor 12 can also be merely a switching element which monitors a working setting of the safety brake and, for example, stops the elevator installation if the safety brake is actuated.

From here on and in the following, the same reference numerals are used for the same features in all figures and accordingly are explained again only when required.

A side view of the safety brake 1 according to the invention is schematically illustrated in FIGS. 2 to 7 in sequentially successive operational states. For better understanding, the safety brake 1 is illustrated in co-operation with the guide rail 4, although the guide rail 4 is not a component of the safety brake 1.

Figure 2:
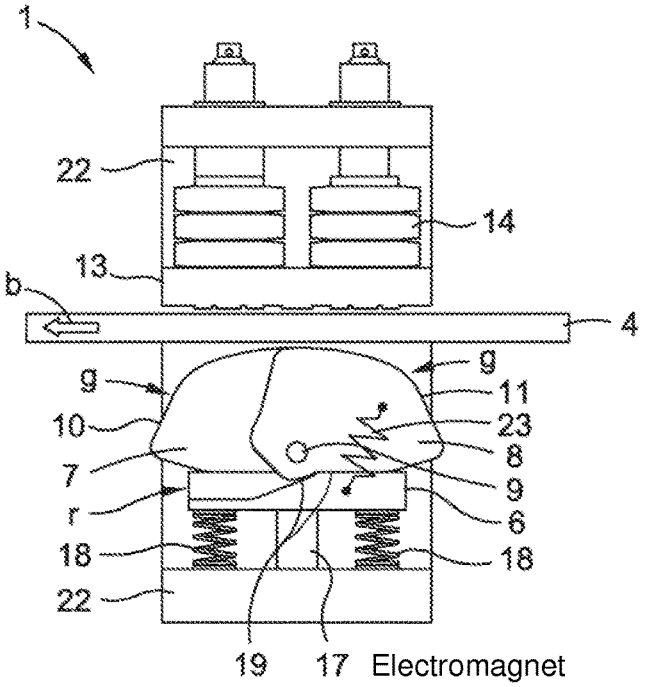
FIGS. 2 to 7 show schematic illustrations of a safety brake according to the invention in sequential operational states.
Figure 3:
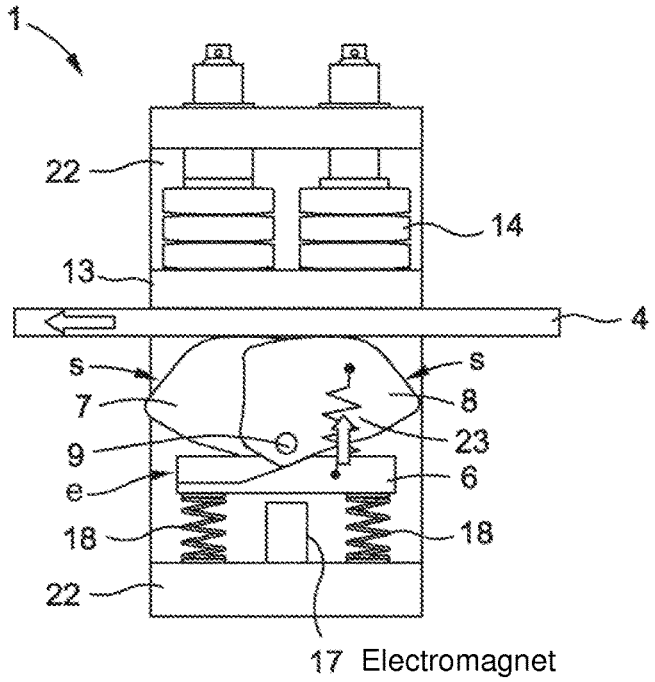

The safety brake 1 comprises a support 22. The support 22 forms a housing-like load-bearing structure for absorption of clamping forces of the safety brake device. An axle 9 is fixedly arranged in the support 22. In addition, the safety brake 1 includes a two-level brake body, comprising a first brake element 7 and a second brake element 8. The two brake elements are constructed as eccentric discs and pivotably arranged on the common axle 9. A control plate 6 is arranged in or at the support 22 to be displaceable between a rest position r (FIG. 2) and a braking position e (FIG. 3). The control plate 6 has a surface 19 (FIG. 4) as an outer contact area. The surface 19 interacts with the brake elements 7, 8. In addition, an electromagnet 17 and compression springs 18 are arranged in the support 22. The electromagnet 17 holds the control plate 6 in the rest position r against a force of the compression springs 18. Moreover, a spring 23 resiliently draws the second brake element 8 against the control plate 6 or against the surface 19 of the control plate 6. The second brake element 8 is thus disposed in the basic position g (FIG. 2). Analogously, the first brake element 7 is held by a spring (not illustrated) in the basic position g.

A counter-braking body 13 is arranged on or in the support 22 on the side of the guide rail 4 remote from the first and second brake elements 7, 8. The counter-braking body 13 is supported in the support 22 by means of plate springs 14 and can be pressed against the guide rail 4 so that a braking action is achievable by the safety brake 1. A pressing force of the brake body 13 against the guide rail 4 is settable by, for example, selection of the bias of the plate springs.

The first brake element 7 has a first braking area 10 and is disposed in the basic position g. The second brake element 8 has a second braking area 11 and is similarly disposed in the basic position g. The braking area 11 is larger than the braking area 10, which, however, is not evident in FIGS. 2 to 6.

The arrow denoted by b characterizes the relative movement between the travel body, at which the safety brake 1 is arranged, and the guide rail 4. The travel body is moved in downward direction b, which is illustrated in FIGS. 2 to 6 as movement of the guide rail 4. Thus, a co-ordinate system fixed relative to the safety brake 1 has been selected.

The control plate 6 is disposed in FIG. 2 in the rest position r and is held by means of the electromagnet 17, which can be switched off, in the rest position r. In addition, arranged at the control plate 6 are the compression springs 18 by means of which after switching-off of the electromagnet 17 the control plate 6 is movable into a braking position s (FIG. 3). The braking elements 7, 8 and also the counter-braking body 13 have a gap relative to the guide rail 4 so that the travel body is freely movable along the guide rails.

The safety brake 1 is illustrated in FIG. 3 in a first operating state in which the electromagnet 17 is switched off and the control plate 6 has been brought by means of the compression springs 18 into the braking position e. Through co-operation of the wedge-shaped surface sections of the surface 19 of the control plate 6 and a rear-side shape of the first brake element 7 and the second brake element 8 the two brake elements 7, 8 are pivoted in opposite directions about the axle 9. A respective curved region of each of the brake elements 7, 8, which are constructed as eccentric discs, is thereby brought into contact with the guide rail 4. The two brake elements 7, 8 are now disposed in a first braking position s. They are pressed against the guide rails by a pressing force determined by the compression springs 18.

Figure 4:
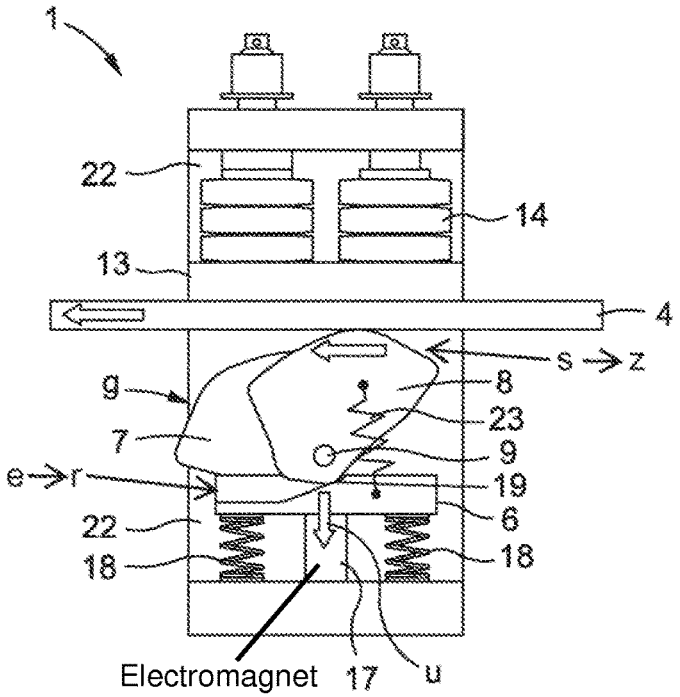

As illustrated in FIG. 4, one of the two brake elements 7, 8 is further pivoted through the contact between guide rail 4 and two brake elements 7, 8 by means of friction couple by way of the relative movement of the guide rail 4. In the example, depending on the direction of the relative movement the second brake element 8 is further pivoted. In that case due to the shape of the brake elements similar to eccentrics the first brake element 7 loses contact with the guide rail 4 and it is drawn back by its spring (not illustrated) towards the control plate. Due to the shape and arrangement of the second brake element 8 and the surface 19 of the control plate 6 the control plate 6 is simultaneously moved back in direction u into the rest position e.

Figure 5:
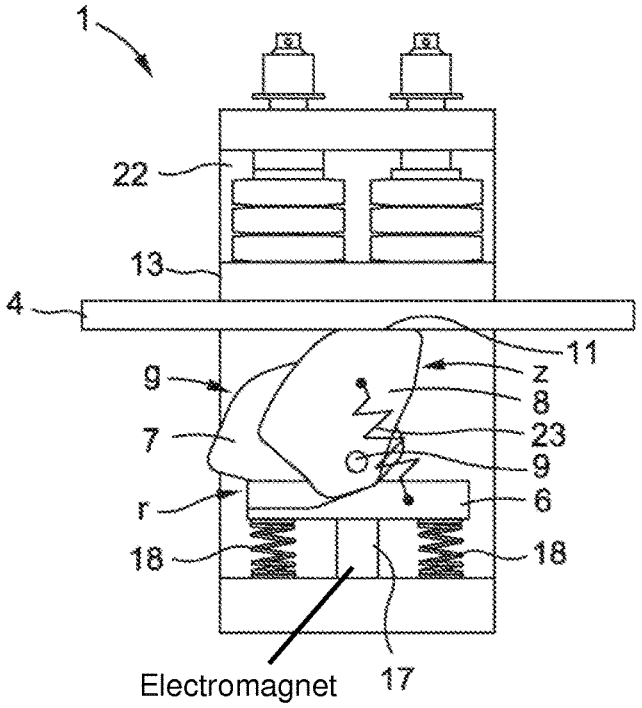

In FIG. 5 the pivotation of the second brake element into a second braking position z is concluded, whereby the second braking area 11 has been brought into contact with the guide rail 4. The brake element 8 has during the clamping in the second braking position z drawn the support 22 together with the counter-braking lining 13 towards the guide rail and stressed the plate springs 14 so that a desired braking force could be built up. The brake elements 7, 8 are preferably provided with end abutments relative to the support 22 so that further rotation of the brake elements 7, 8 on reaching the second braking position z is prevented.

In addition, during the clamping of the second brake element 8 in the second braking position z the control plate 6 was moved into the rest position r and is again in contact with the electromagnet 17. The compression springs 18 are biased again. The electromagnet 17 is arranged to be yielding substantially parallel to the action of the restoring force u so that bridging-over is made possible in order to guarantee contact between control plate 6 and electromagnet 17 during resetting.

Figure 6:
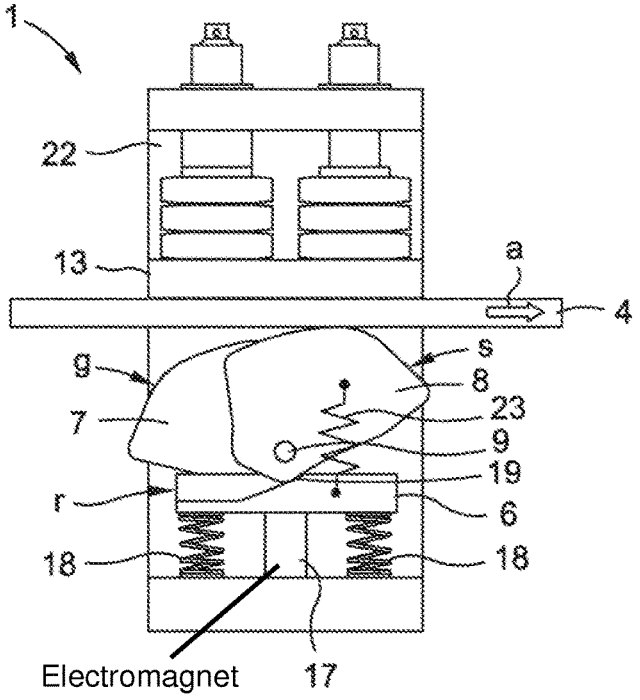

As illustrated in FIG. 6, after braking or fixing of the travel body by means of the safety brake 1 the travel body is moved in an upward direction a, which is also here illustrated by a movement of the guide rail 4. As a result, resetting of the second brake element 8 into the first brake position s and thus release of the safety brake 1 take place. The electromagnet 17 is switched on at the latest on reaching the first braking position s or, better, already beforehand so as to hold the control plate in the rest position r.

Figure 7:
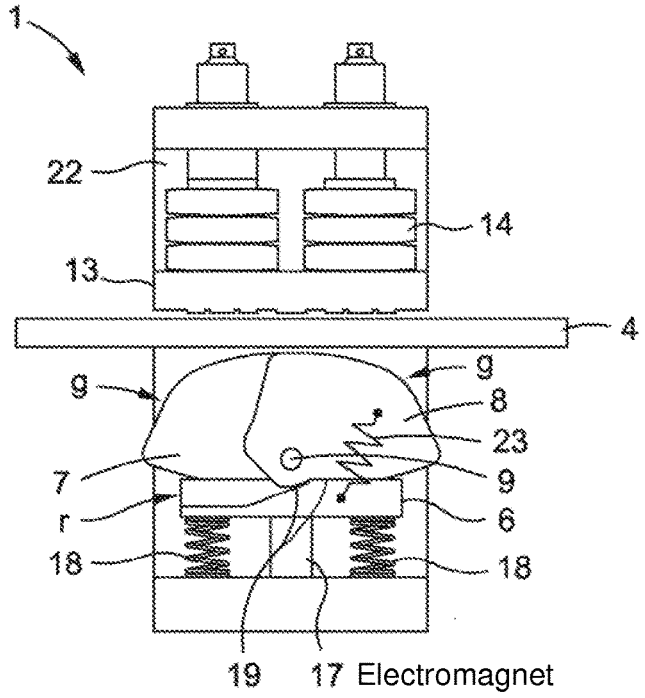

As illustrated in FIG. 7, the second braking element 8 is pivoted back into the basic position g, which can be achieved by the spring 23. The safety brake is again reset into its original position in correspondence with FIG. 2.

Figure 8:
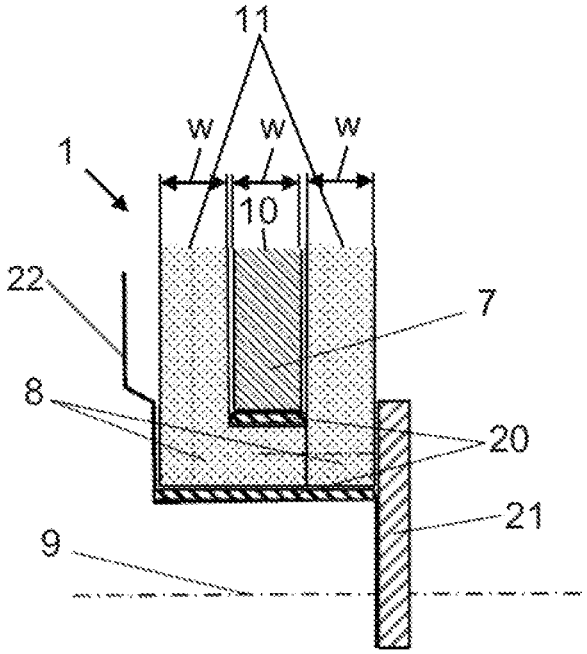
FIG. 8 shows a sectional side view of a brake body of the safety brake according to the invention.

A detail of the safety brake 1 is illustrated in FIG. 8 in a sectional illustration through the axle. The axle 9 is executed as a component of the support 22. In addition, the first brake element 7 and the second brake element 8 are again arranged at the axle 9. The two brake elements 7, 8 are mounted, multi-level, on the axle 9 by means of a fastening disc 21. The first brake element 7 has a first braking area 10, which is approximately 50% of the second braking area 11 of the second brake element 8. The first brake element 7 is arranged between the two brake parts of the second brake element 8. The brake parts all have a thickness w of 9 to 12 millimeters. The axle 9 is dimensioned in order to take over the clamping forces arising on clamping of the brake element 7, 8 in the second braking position.

The safety brake 1 additionally comprises slide bearings 20, by means of which the brake elements are pivotable as described in the foregoing.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A safety brake for an elevator installation with at least one travel body movable along at least one of a guide rail and a brake rail in an elevator shaft, wherein the safety brake brakes and holds the travel body at the rail when required, the safety brake comprising:

a brake body having a first brake element and a second brake element, wherein the first and second brake elements are movable independently of one another, the first brake element and the second brake element are pivotable in opposite directions about a common axle, and the first brake element is substantially for braking and holding only in case of movement of the travel body along the rail in an upward direction and wherein the second brake element is for braking and fixing only in case of movement of the travel body along the rail in a downward direction; and a control plate for positioning the brake body relative to the guide wherein the first and second brake elements are adjustable together relative to the rail to simultaneously bring the first brake element and the second brake element into contact with the guide rail, wherein the control plate is positionable in each of a rest position and a braking position by a linear movement relative to the rail.

2. The safety brake according to claim 1 wherein the control plate is held in the rest position by an electromagnet that is switched on by being provided with electric power, and wherein the electromagnet is switched off by not being provided with electric power to enable the control plate to move into the braking position by a compression spring.

3. The safety brake according to claim 1 wherein at least one of the first brake element and the second brake element is pivotably arranged on the axle at a support of the safety brake and the control plate is arranged at the support to be linearly movable or pivotably movable to position the at least one of the first brake element and the second brake element relative to the rail.

4. The safety brake according to claim 3 wherein the first brake element and the second brake element are pivotable at the same time by the control plate to pivot from a basic position out of contact with the rail to a first braking position in contact with the rail.

5. The safety brake according to claim 4 wherein the at least one of the first brake element and the second brake element is pivotable by friction locking with the rail from the first braking position to a second braking position.

6. The safety brake according to claim 5 wherein the control plate is movable from the braking position to the rest position by pivotation of the at least one of the first brake element and the second brake element from the first braking position to the second braking position.

7. The safety brake according to claim 1 wherein at least one of the first brake element and the second brake element is formed as an eccentric disc.

8. The safety brake according to claim 7 wherein the eccentric disc is curved in a section in contact with the rail in a first braking position, and the eccentric disc is planar in a section in contact with the rail in a second braking position.

9. The safety brake according to claim 8 wherein a side of the eccentric disc remote from the rail is configured such that through pivotation of the eccentric disc, from the first braking position to the second braking position, a reset force is exerted on the control plate by the side of the eccentric disc to move the control plate into the rest position.

10. The safety brake according to claim 8 wherein the control plate has a contact surface whereby on movement of the control plate into the first braking position the eccentric disc is pivoted into the first braking position by interaction with the contact surface and a restoring force is exerted on the control plate on pivotation of the eccentric disc into the second braking position.

11. The safety brake according to claim 1 wherein a first braking area of the first brake element is smaller than a second braking area of the second brake element.

12. The safety brake according to claim 11 wherein the first braking area is at most 75% of the second braking area.

13. The safety brake according to claim 11 wherein the first braking area is at most 60% of the second braking area.

14. The safety brake according to claim 1 wherein the second brake element has two eccentric discs with substantially a same braking area, wherein the first brake element has a first braking area substantially equal to the braking area of one of the eccentric discs, and wherein the first brake element is arranged between the two eccentric discs of the second brake element.

15. The safety brake according to claim 1 including a sensor for at least one of position monitoring and state monitoring of at least one of the first brake element, the second brake element and the control plate.

16. The safety brake according to claim 1 wherein at least one of the first brake element and the second brake element is biased in a direction of the control plate by at least one spring.

17. An elevator installation having a travel body and a safety brake according to claim 1 arranged at the travel body.

18. A method for braking and holding a travel body of an elevator installation with a safety brake when required, wherein the safety brake includes a control plate for positioning an at least two-part brake body relative to at least one of a guide rail and a brake rail, the method comprising the steps of:

adjusting a first brake element and a second brake element of the brake body relative to the rail by moving the control plate relative to the rail to bring the first and second brake elements into a first braking position, and thereby simultaneously bringing the first brake element and the second brake element in contact with at least one of the guide rail and the brake rail, wherein the first brake element and the second brake element are pivotable in opposite directions about a common axle; and moving the travel body along the rail in an upward direction to bring the first brake element independently of the second brake element from the first braking position into a second braking position, or moving the travel body along the rail in a downward direction to bring the second brake element independently of the first brake element from the first braking position into the second braking position.

* * * * *